US005216436A

United States Patent [19]

Hall et al.

[11] Patent Number: 5,216,436

[45] Date of Patent: Jun. 1, 1993

[54] COLLAPSIBLE, LOW VISIBILITY, BROADBAND TAPERED HELIX MONOPOLE ANTENNA

[75] Inventors: John P. Hall, Palm Bay; Thomas J. Kabana, W. Melbourne; Albert J. Massanova, Satellite Beach; M. Phillip Arnold, Melbourne, all of Fla.

[73] Assignee: Harris Corporation, Melbourne, Fla.

[21] Appl. No.: 708,751

[22] Filed: May 31, 1991

[51] Int. Cl.[5] ..... H01Q 1/360; H01Q 11/040; H01Q 11/080; H01Q 1/080

[52] U.S. Cl. ..... 343/895; 343/752; 343/828; 343/899

[58] Field of Search ..... 345/895, 729, 749, 752, 345/899, 741, 742, 867, 792.5, 825, 828

[56] References Cited

U.S. PATENT DOCUMENTS

| | | | |
|---|---|---|---|
| 2,964,748 | 12/1960 | Radford | 343/899 |
| 2,982,964 | 5/1961 | Bresk et al. | 343/895 |
| 3,035,266 | 5/1962 | Marshall | 343/899 |
| 3,510,872 | 5/1970 | Mullaney | 343/895 |
| 3,618,109 | 11/1971 | Werner | 343/792.5 |
| 4,498,084 | 2/1985 | Werner et al. | 343/895 |

*Primary Examiner*—Rolf Hille
*Assistant Examiner*—Peter Toby Brown
*Attorney, Agent, or Firm*—Evenson, Wands, Edwards, Lenahan & McKeown

[57] ABSTRACT

A collapsible 'bedspring' monopole antenna is configured to be effectively non-observable in its collapsed condition and, when deployed, remains sufficiently compact to ensure very low observability characteristics, while providing broadband coverage over a wide viewing aperture. The antenna is comprised of a conductor formed as a tapered helix. One end of the conductor is coupled to an antenna feed. The outer end of the helix is looped around on itself to form a circular loop. A plurality of substantially rectilinear 'radials' are soldered to distributed locations around its circular loop, so as to extend outwardly and tangentially from the outer perimeter of the loop and provide 'top hat' capacitive matching elements. To define the height of the deployed antenna and to electrically short out plural locations of the helix, a plurality of conductive straps are joined to respective spaced apart locations of the helix. When allowed to expand toward its deployed configuration, the bedspring imparts a tensile force to the straps, which are pulled taught, thereby limiting the expansion of the bedspring. That portion of the helix between the closest point of strap attachment and its feed point effectively inserts an inductance in the antenna circuit path between the feed point and what is effectively an 'open mesh cone-shaped monopole'.

22 Claims, 1 Drawing Sheet

COLLAPSIBLE, LOW VISIBILITY, BROADBAND TAPERED HELIX MONOPOLE ANTENNA

The present invention was conceived and reduced to practice in conjunction with the performance of a U.S. Government Contract, specifically DARPA/ARDEC Contract No. DAAA21-88-C-0131.

FIELD OF THE INVENTION

The present invention relates in general to electromagnetic wave antennas and is particularly directed to a compact antenna structure which is deployable from an axially compressed and substantially flattened spiral configuration to a low visibility, tapered helix, wide bandwidth, mesh cone monopole configuration.

BACKGROUND OF THE INVENTION

Mobile communication systems, such as those mountable to a vehicle or manually deployable for terrestrial applications, customarily employ a vertical monopole antenna having a substantially omnidirectional radiation/sensitivity pattern. Preferably such antennas are both lightweight and compact, for ease of transport and attachment to an attendant transceiver housing. Because the effective electrical length of the monopole element is usually an appreciable fraction of a wavelength of the radiated wave (typically on the order of one-quarter to one-half a wavelength), geometries other than a straight wire have been proposed in order to reduce the actual physical length of the antenna structure to a manageable size. For example, each of the U.S. Pat. No. to Henderson, 4,087,820, Zandbergen, U.S. Pat. No. 4,435,716 and Eroncig, U.S. Pat. No. 4,097,867 describes a quarter wavelength monopole structure having a generally helically configured design for use with a citizens band radio. The helical monopole described in the Henderson patent is mounted within a variable length cylindrical tube or mast, while the conical helix antennas described by Zandbergen and Eroncig have a varying diameter along the longitudinal axis of the antenna. German Offenlegungsschrift No. 1813292 also discloses a conical helix antenna structure similar to that described by Zandbergen, formed of a spirally wound conductor that is fed from the wide diameter portion of the spiral.

Now although helical antenna structures of the type described in the above-referenced literature may be useful in mobile communication systems such as citizens band radios, they still possess substantial physical size that makes them readily visually detectable. For certain mobile or field deployable applications, the antenna must possess substantial low observability characteristics. For example, high performance aircraft customarily employ radiator elements that are embedded in or conformal with the airframe. In harsh terrestrial environments, such low observability characteristics particularly serve to minimize potential discovery by a variety of hostile or system defeating threats. Thus, the successful deployment of a radio-linked command and control system often depends not only upon its antenna's functionality as a preferably broadband electromagnetic wave interface device, but also upon the antenna's ability to perform such functionality, while still complying with minimum hardware requirements of the remainder of the system.

Unfortunately, conventional quarter-wavelength or longer monopole antennas, such as those described above, have a substantial dimension along the direction of deployment (often a length of several feet or more), so that they are not considered to possess low observability characteristics. In addition, where it is desired to extend the antenna coverage of a conventional monopole over a wide bandwidth, it is necessary to incorporate a plurality of switchably inserted or stepped tuning networks in circuit with the antenna, something which packaging constraints on a miniaturized transceiver package from which the antenna is deployed may prohibit.

SUMMARY OF THE INVENTION

In accordance with the present invention, there is provided a new and improved field-deployable monopole antenna structure that provides omnidirectional coverage, and is effectively non-observable in its stowed or collapsed condition. Moreover, when deployed, the antenna remains physically compact, so that it is 'electrically' short (much less than a quarter-wavelength), thereby possessing very low observability, yet still providing broadband performance without the need to switchably insert auxiliary tuning networks in circuit with the antenna. To this end, the broad bandwidth monopole antenna structure of the present invention is comprised of a conductive mesh structure mechanically configured as a tapered helix, similar to a 'bedspring', and configured electrically as a solid cone, with the topmost portion of the 'bedspring' being the largest diameter portion of the helix and the lowermost or base portion of the 'bedspring' being the smallest diameter portion of the helix. Because the helix follows a generally tapered (e.g. conical) path, it may be concentricllly compressed or collapsed along its vertical axis into what is effectively a single layer (generally spiral) shape. Moreover, because of its reduced height 'bedspring' configuration, the antenna is, in effect, an electrically 'fat' (low Q) cone-shaped monopole, having reduced capacitive coupling to a groundplane at its base mount region.

The cross-sectional area of the conductor used to form the tapered helix is preferably graduated from a minimum area or thickness at the topmost portion of the helix to a maximum, reinforcing size at the base of the antenna, thereby imparting a substantial amount of strength and rigidity to the lower portion of the antenna. The conductor used to form the tapered helix may comprise plural lengths of beryllium-copper wire stacked in a successively overlayed or laminate shape and wound in a helical fashion around a conically shaped mandrel, so as to form the graduated thickness conductor into the desired 'bedspring' shape. The length of the resultant tapered helix is longer than the eventual deployed state of the antenna. In its deployed state, the bedspring is slightly compressed, so as to retain some degree of tensile force.

The topmost portion of the conically wound helix is looped and bonded to itself, forming a closed circular ring. A plurality of substantially rectilinear conductor elements or 'radials' are attached (e.g. soldered) at distributed locations around this top ring portion of the antenna, so as to extend outwardly and tangentially from the outer perimeter of the closed ring and provide 'top hat' capacitive loading.

In order to precisely define the height of the antenna in its slightly compressed, deployed state, and to effectively short out the tapered helix and thus realize a conductive mesh structure that approximates the shape of an electrically short, 'fat' cone, successive diameter portions of the helix are joined together by lengths or straps of a flexible conductive material, such as copper coated steel braid or ribbon, which readily collapses or self-folds within the confines of the helix when it is fully compressed to its stowed condition. When the antenna is deployed vertically from this fully compressed state, these lengths of flexible conductive braid are drawn taught and retained in tension by the expanded 'bedspring', thereby defining the height of the deployed antenna in what becomes an open mesh inverted cone configuration. Because the lengths of the straps of flexible conductive braid between successive attachment locations along the axial or longitudinal direction of the tapered helix are less than the 'at rest' separation between such locations for a non-constrained condition of the bedspring, there remains sufficient tensile force within the partially compressed bedspring to pull the flexible conductive braid taught, so that the deployed dimension of the antenna may be precisely and repeatably defined by the lengths of the longitudinally extending conductive ribbon segments or straps.

The respective segments or straps of flexible conductive braid or ribbon extend from locations along the helically wound conductor that are spaced apart from the base feed point outwardly to distributed locations around the top circular loop portion of the helix. That portion of the helix which corresponds to the closest point of braided ribbon attachment and the antenna feed point effectively inserts an inductance in the antenna circuit path between the feed point and the open mesh structure. Thus, the deployed tapered helix structure has both capacitive and inductive loading (at respective opposite ends of the structure) to facilitate broadband matching with associated signal processing circuitry (a transceiver unit) to which the antenna feed port is coupled.

DETAILED DESCRIPTION

Figure 1:
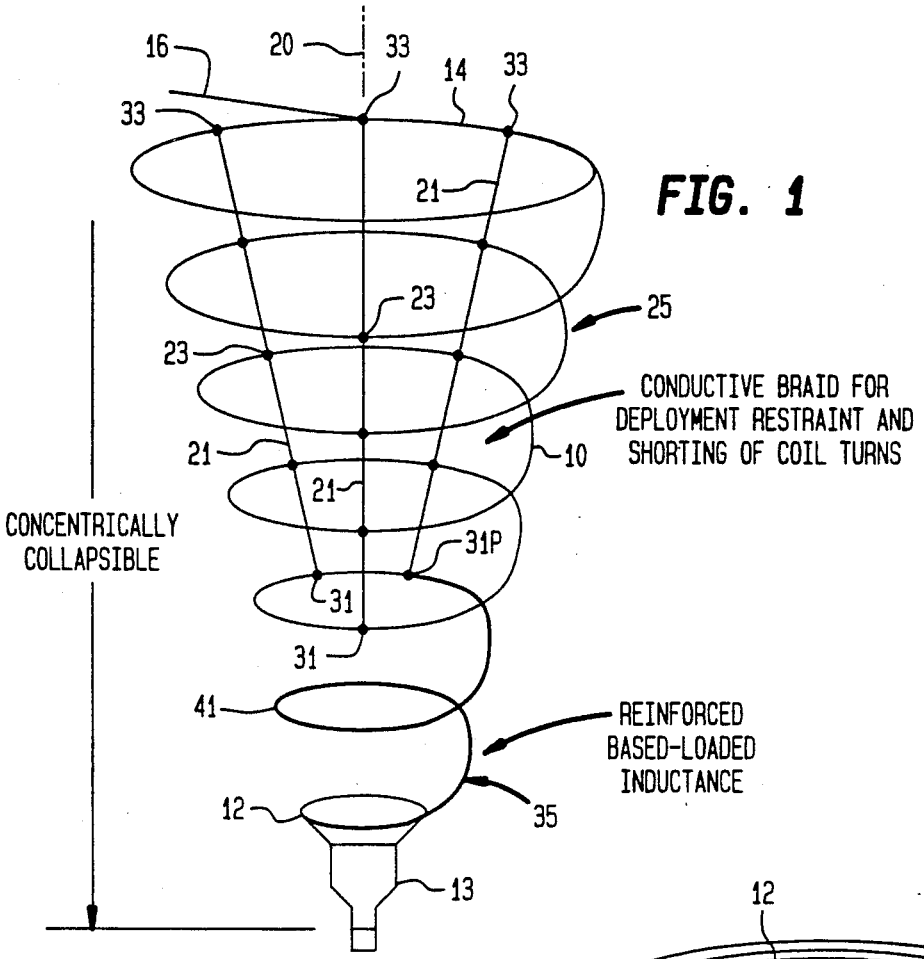
FIGS. 1 and 2 are diagrammatic perspective views of respective deployed and collapsed conditions of a conical helix antenna structure in accordance with the present invention.
Figure 2:
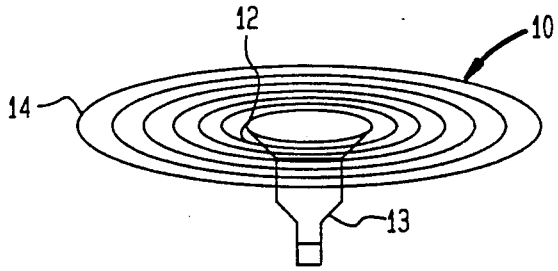

Referring now to FIGS. 1 and 2, respective diagrammatic perspective views of the deployed and collapsed conditions of the antenna structure of the present invention are shown. As described above and as diagrammatically shown in FIG. 1, the antenna structure of the present invention comprises an electrically short, 'fat' compressible tapered helix or 'bedspring'-configured conductor 10, which is effectively non-observable in its stowed, substantially flat condition and, when deployed, remains sufficiently compact and electrically short to ensure a very low observable condition. By electrically short is meant a dimension considerably less than the conventional quarter-wavelength dimension of a monopole antenna. For example, the effective electrical length of the tapered helix monopole along axis 20 may be on the order of only one-sixteenth of a wavelength. For a center frequency of 75 MHz within an operational bandwidth of 25 MHz, the deployed height of helix 10 may be only on the order of sixteen inches.

As shown in FIG. 1, the tapered helix or bedspring shape of the antenna 10 is such that the topmost portion 14 of the helix is the largest diameter portion of the helix and the lowermost or base 12 of the 'bedspring' is the smallest diameter portion of the helix. Because the helix follows a generally conical path of increasing diameter from base 12 to its topmost portion 14, it may be concentrically compressed or collapsed along its vertical axis 20 into what is effectively a single layer (generally spiral) shape, as diagrammatically shown in FIG. 2. Moreover, because of its 'bedspring' shape, the antenna enjoys a low Q and has reduced capacitive coupling to a groundplane at its reduced diameter base mount region 13.

Figure 3:
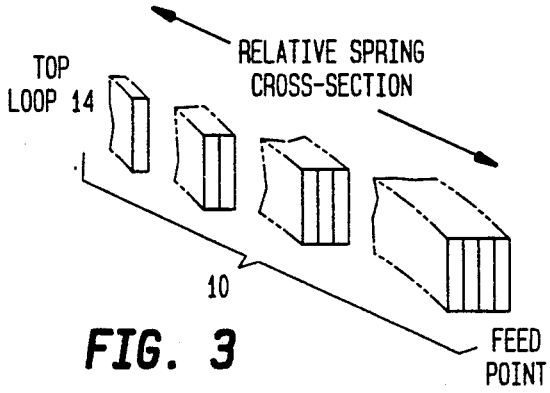
FIG. 3 shows the cross-section of the helically wound conductor of the antenna of FIGS. 1 and 2 at successive locations along the length of the helix.

The cross-sectional area of the conductor used to form the tapered helix 10 is preferably graduated from a minimum area or thickness at the topmost portion 14 of the helix to a maximum, reinforcing size at the base 12 of the antenna, thereby imparting a substantial amount of strength and rigidity to the lower portion of the antenna. For this purpose, the conductor used to form the tapered helix may comprise plural lengths of beryllium-copper wire having a generally rectangular cross-section and stacked in a successively overlayed or laminate shape, as shown in FIG. 3. The wire laminate is oriented such that its longer cross-sectional dimension is generally parallel to the longitudinal axis 20 of the antenna, while its shorter cross-sectional dimension is generally transverse to the longitudinal axis, thereby aligning the 'strength' or longer cross-sectional dimension with the vertical, deployed direction. It should be observed that the conductor of which helix 10 is formed is not limited to a laminated, rectangular cross-section type of conductor, but may be of other cross-sectional shapes, such as a gradually increasing circular cross-sectional wire, or a tempered spring material having a uniform cross-section. The example given here is merely illustrative of one type of conductor that may be used to realize the desired graduated thickness along the length of the helix. When such a laminated structure is used, the number of segments within the stack is largest at the base or bottom of the antenna and is decreased as one proceeds upwardly along the helix, so that the wire is thinnest at its top widest diameter portion and thickest at the base of the antenna.

To form the wire into a bedspring or helical shape, the graduated cross-section conductor laminate may be wound in a helical fashion around a tapered (e.g. conically shaped) mandrel. The formed length of the resultant tapered helix along its longitudinal axis is such that the formed antenna, in its at rest condition, is longer than the eventual deployed state of the antenna. As noted above, in its deployed state, the bedspring is partially compressed, so as to impart a tensile force to the conductive ribbon used to electrically short successive diameter portions of the helix into an open mesh, fat monopole structure 25.

Figure 4:
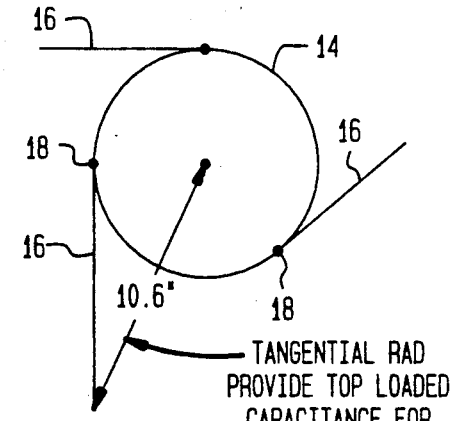
FIG. 4 is a diagrammatic plan view of the antenna of FIGS. 1 and 2, showing a plurality of substantially rectilinear conductor radicals attached to the spiral antenna at distributed locations around its circular loop end.

The topmost, smallest thickness portion 14 of the conically wound, graduated thickness helix is looped and bonded to itself, forming a closed circular ring 14, as shown in FIG. 4. A plurality of substantially rectilinear conductor elements or 'radials' 16 are then attached (e.g. soldered) at distributed locations 18 around this top ring portion 14 of the antenna, so as to extend outwardly and tangentially from the outer perimeter of the closed ring and provide 'top hat' capacitive loading. In the present example, such tangentially deployed radials 16 may comprise respective lengths of individual segments of the wire of which the topmost diameter portion of the helix is formed.

In order to precisely define the height of the antenna in its deployed (yet partially compressed) state, and to effectively short out the tapered helix and thus realize a conductive mesh structure that approximates the shape of an electrically short, 'fat' cone monopole structure, successive diameter portions 23 of the helix 10 are joined together by lengths of a flexible conductive material 21, such as copper coated steel braid or ribbon, which readily collapses or self-folds within the confines of the helix, when it is fully compressed to its stowed condition. Subsequently, when the antenna is deployed vertically from its fully compressed state, shown in FIG. 2, these lengths of flexible conductive braid 21 are drawn taught and retained in tension by the expanded 'bedspring', thereby defining the height of the deployed antenna in what becomes the open mesh cone configuration of FIG. 1. Because the lengths of the flexible conductive braid 21 between successive attachment locations 23 along the axial or longitudinal direction 20 of the tapered helix are less than the 'at rest' separation between such locations for a non-constrained condition of the bedspring, there remains sufficient tensile force within the partially compressed bedspring-configured conductor 10 to urge the flexible conductive braid taught, so that the deployed height of the antenna may be precisely and repeatably define by the lengths of the longitudinally extending conductive ribbon segments.

The respective segments 21 of flexible conductive braid or ribbon extend from lowermost locations 31 along the helically wound conductor 10 that are spaced apart from base feed point 13 outwardly to distributed locations 33 around the top circular loop portion 14 of the helix. That portion 35 of the helix between the closest point of braided ribbon attachment 31P and the antenna feed point 13 effectively inserts a helical inductive reactance 41 in the antenna circuit path between feed point 13 and the open mesh structure 25. Thus, the deployed tapered helix structure has both capacitive and inductive loading (at respective opposite ends of the mesh-configured cone monopole structure) to facilitate broadband matching with associated signal processing circuitry (a transceiver unit) to which the antenna feed port 13 is coupled.

As noted above, when concentrically collapsed into its stowed or compressed state, the conical helix, together with the tangentially attached radial segments 16 take on a generally flat, single layer, spiral configuration as shown in FIG. 2. The respective segments of flexible ribbon 21 are readily folded between adjacent diameter portions of the conical helix, so that the entire structure lies in a substantially flat configuration, permitting it to be compactly nested atop an associated signal processing unit (e.g. radio transceiver). Housing the associated signal processing unit in a reduced height, cylindrical canister permits the antenna to be readily interconnected with the radio and conformally integrated atop the housing structure. A strap or a disc shaped cover/lid may be employed to confine the antenna in its collapsed condition atop the canister.

When the unit is placed in the field, for example as part of a command and control subsystem package that may be buried just beneath the surface of the terrain, the unit and the collapsed antenna are essentially invisible. Removal of the antenna cover permits the folded braided ribbon segments to unfurl as the bedspring-shaped monopole structure releases outwardly until the braid segments are drawn taught in a rectilinear shape and thereby limit the extent to which the conical helix may deploy away from its base mount. Advantageously, in a typical application of the antenna structure in accordance with the present invention as a VHF antenna for a command and control subsystem operating over a 25 MHz bandwidth at a center frequency on the order of 75 MHz, noted previously, the dimensions of the structure are relatively compact—a maximum helical diameter on the order of only seven inches and a deployed height on the order of only sixteen inches, so that, in addition to being broadband, the antenna enjoys very low observability characteristics.

Radiation pattern measurements conducted on the electrically short, fat mesh-cone monopole antenna structure in accordance with the present invention reveal that its radiation pattern very closely approximates that of a conventional quarter wavelength monopole, so that the antenna of the present invention enjoys both low visible detectability and reduced radio interception at elevation.

Although the tapered helix mesh antenna of the present invention has been described as being collapsible, it should be observed that the present invention may be assembled as a non-collapsible unitary structure. For this purpose, the bedspring-configured antenna may be shorted out into a mesh cone, by soldering plural rectilinear sections of wire to successively larger diameter locations of the helix, so as to produce a configuration substantially as shown in FIG. 1. A plurality of radials are then tangentially soldered around the largest diameter circular loop end of the helix and the narrow diameter end is reinforced and attached to an antenna feed element.

As will be appreciated from the foregoing description, the concentrically collapsible conical helix antenna in accordance with the present invention is effectively non-observable in its stowed (collapsed) configuration and, when deployed, still remains sufficiently compact to ensure a very low observable condition while providing broadband, omnidirectional coverage. Consequently, it is readily adaptable to harsh terrestrial environments applications, where low observability characteristics are particularly necessary in order to minimize potential discovery by hostile or system defeating threats.

While we have shown and described an embodiment in accordance with the present invention, it is to be understood that the same is not limited thereto but is susceptible to numerous changes and modifications as known to a person skilled in the art, and we therefore do not wish to be limited to the details shown and described herein but intend to cover all such changes and modifications as are obvious to one of ordinary skill in the art.

What is claimed:

1. A monopole antenna comprising:

an electrically conductive structure which is conically tapered from a first end thereof to a second end thereof, said first end having a diameter that is smaller than a diameter of said second end;

an antenna feed coupled to said first end of said electrically conductive structure; and a plurality of conductor elements attached to and tangentially extending from spaced apart locations of said second end of said electrically conductive structure; and wherein the conductive material of said electrically conductive structure comprises a conductor formed in the shape of tapered helix, which extends along an axis from a first helix diameter portion to a second helix diameter portion larger than said first helix diameter portion, and a plurality of electrically conductive attachment elements, exclusive of the conductor formed in the shape of a tapered helix, which conductively attach respectively different helix diameter portions of said conductor to one another.

2. A monopole antenna according to claim 1, wherein said plurality of electrically conductive attachment elements comprise a plurality of conductive straps attached to respectively different helix diameter portions of said conductor.

3. A monopole antenna according to claim 2, wherein the lengths of said conductive straps between attachment points of respectively different helix diameter portions of said conductor are less than the at rest separation of said respectively different helix diameter portions of said conductor.

4. A monopole antenna according to claim 1, wherein the cross section of said conductor is smaller at said second helix diameter portion of said conductor than at said first helix diameter portion of said conductor.

5. A monopole antenna according to claim 4, wherein the size of the cross section of said conductor is graduated from a first area at said second helix diameter portion of said conductor to a second area, larger than said first area, at said first helix diameter portion of said conductor.

6. A monopole antenna according to claim 1, wherein the size of the cross section of said conductor increases from said second helix diameter portion of said conductor to said first helix diameter portion of said conductor.

7. A monopole antenna according to claim 1, wherein said conductor comprises a tempered conductive spring.

8. A monopole antenna according to claim 1, wherein first ends of said conductive attachment elements are joined to locations along said conductor located between said first and second helix diameter portions thereof, so that an inductor element is formed between said antenna feed and one of said locations, said one of said locations being a location which is closest to said antenna feed.

9. A collapsible and deployable monopole antenna comprising:

a conductor formed in the shape of a conical helix-shaped spring, said conical helix-shaped spring having a first end coupled to an antenna feed and a second end forming a closed circular loop, and wherein said conical helix-shaped spring is deployable along an axis; and a plurality of conductor elements joined with the closed circular loop of the second end of said helix-shaped spring, said conductor elements extending outwardly and tangentially from a plurality of locations around said closed circular loop.

10. A collapsible and deployable monopole antenna according to claim 9, further including a plurality of conductive strap elements which conductively join respectively different diameter portions of said conical helix-shaped spring.

11. A collapsible and deployable monopole antenna according to claim 10, wherein first ends of said conductive strap elements join locations along said conical helix-shaped spring, spaced apart from said feed, to said closed circular loop portion, so that an inductor element is formed between said antenna feed and one of said locations, said one of said locations being a location which is closest to said antenna feed.

12. A collapsible and deployable monopole antenna according to claim 9, wherein the deployed height of said conical helix-shaped spring is substantially less than one-quarter of the wavelength of the operational frequency of said antenna.

13. A collapsible and deployable monopole antenna according to claim 9, wherein the cross section of said conductor is smaller at its second, closed loop end than at its first, antenna feed end.

14. A collapsible and deployable monopole antenna according to claim 9, wherein the size of the cross section of said conductor is graduated from a first area at said second end of said conductor to a second area, larger than said first area, at said first end of said conductor.

15. A collapsible and deployable monopole antenna according to claim 9, wherein the size of the cross section of said conductor increases from said second end of said conductor to said first end of said conductor.

16. A collapsible and deployable monopole antenna according to claim 9, wherein said conductor comprises a tempered conductive spring and wherein the size of the cross section of said conductor is uniform from said second end of said conductor to said first end of said conductor.

17. A method of deploying an antenna for a radio frequency signal processing unit comprising the steps of:

(a) providing a collapsible and deployable antenna formed of a conductor configured in the form of a tapered helix, which has a first end thereof coupled to an antenna feed that is connectable to said radio frequency signal processing unit, and a second end thereof looped upon itself to form a closed, generally circular loop, said generally circular loop having a plurality of conductor elements joined therewith, so as to extend outwardly and tangentially from a plurality of locations distributed around said closed circular loop, and including collapsible straps conductively interconnecting different diameter spiral portions of said conductor;

(b) connecting said antenna feed to said radio frequency signal processing unit;

(c) collapsing said antenna into a reduced height condition; and (d) allowing tensile force within the compressed antenna to expand said antenna along an axis outwardly from said antenna feed, from its reduced height condition to a height defined by the lengths of said collapsible straps, so as to allow the height of said antenna to increase to that of a tapered helix configuration.

18. A method according to claim 17, wherein step (a) comprises attaching first ends of said collapsible straps to locations along said conductor spaced apart from said antenna feed outwardly to said closed circular loop, so that an inductor element is formed between said antenna feed and one of said locations, said one of said locations being a location which is closest to said antenna feed.

19. A method according to claim 17, wherein the deployed height of said antenna is substantially less than one-quarter of the wavelength of the operational frequency of said antenna.

20. A method according to claim 17, wherein the cross-section of said conductor is smaller at its second, closed loop end than at its first, antenna feed end.

21. A method according to claim 17, wherein the size of the cross-section of said conductor increases from said second end of said conductor to said first end of said conductor.

22. A method according to claim 17, wherein said conductor comprises a tempered conductive spring and wherein the size of the cross-section of said conductor is uniform from said second end of said conductor to said first end of said conductor.

* * * * *